United States Patent [19]

Schier et al.

[11] Patent Number: 4,538,584

[45] Date of Patent: Sep. 3, 1985

[54] DIESEL INTERNAL COMBUSTION ENGINE

[75] Inventors: Karl Schier, Friedrichshafen; Gerd-Michael Wolters, Markdorf, both of Fed. Rep. of Germany

[73] Assignee: MTU- Motoren- und Turbinen-Union Friedrichshafen GmbH, Friedrichshafen, Fed. Rep. of Germany

[21] Appl. No.: 598,796

[22] Filed: Apr. 10, 1984

[30] Foreign Application Priority Data

Jun. 29, 1983 [DE] Fed. Rep. of Germany ..... 3323337

[51] Int. Cl.[3] ..... F02B 33/02

[52] U.S. Cl. ..... 123/559; 123/198 F

[58] Field of Search ..... 123/559, 560, 198 F; 60/605, 612

[56] References Cited

U.S. PATENT DOCUMENTS 4,191,152 3/1980 Deutschmann ..... 123/198 F 4,248,198 2/1981 Deutschmann et al. ..... 123/198 F

*Primary Examiner*—Michael Koczo

*Assistant Examiner*—John J. McGlew, Jr.

*Attorney, Agent, or Firm*—Craig & Burns

[57] ABSTRACT

In a diesel internal combustion engine (10) having a low compression ratio, at least one cylinder (11) operating as engine cylinder is supercharged during starting and in the partial load operation by several cylinders (12, 13) operating as compressor. The piston of the first compressor (12) which is used for the direct charging of the engine cylinder (11), leads the piston of the engine cylinder (11) exactly so far that the air compressed by the same is fed directly into the engine cylinder (11) during the beginning of the compression stroke. At least one further compressor cylinder (13) supplies its air to an air storage device (22) which is connected with the engine cylinder (11) by way of a line (24) adapted to be closed off by a valve (23). The valve is controlled in the opening direction by the compressed air of the first compressor cylinder (12) so that the air of the storage device (22) together with the air of the first compressor cylinder (12) reaches the engine cylinder (11) at the correct instant and is further compressed thereat by the piston of the engine cylinder (11) up to the fuel injection.

4 Claims, 1 Drawing Figure

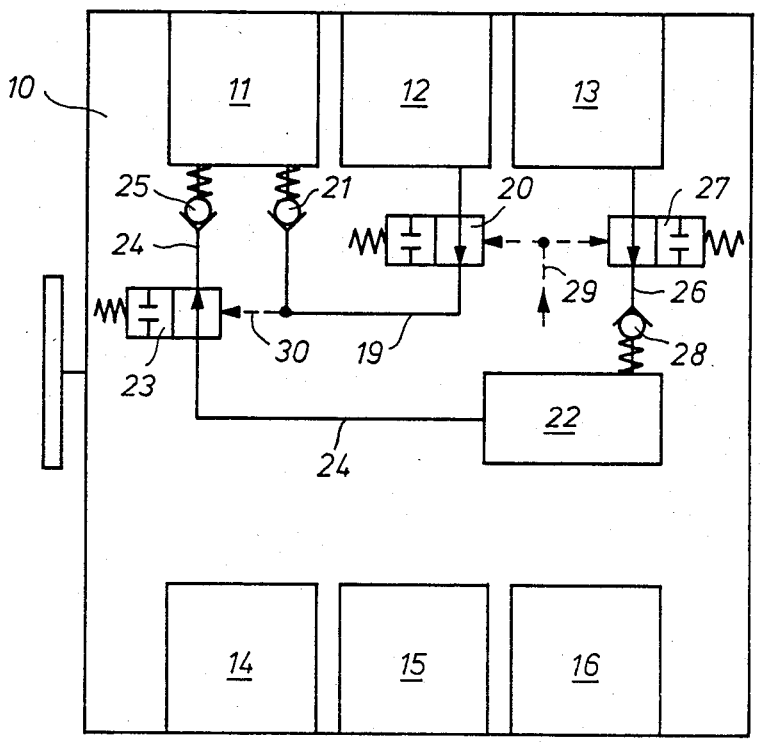
10
11
12
13
25
21
20
27
24
29
26
30
19
28
23
22
24
14
15
16

DIESEL INTERNAL COMBUSTION ENGINE

The present invention relates to a diesel internal combustion engine with low compression ratio and supercharged by an exhaust gas turbocharger, in which during the starting and in the partial load operation at least one cylinder is operated as an engine cylinder which is charged by a cylinder operated as compressor, whereby the piston of the compressor cylinder leads the piston of the engine cylinder to such an extent that the engine cylinder is charged directly by the compressor cylinder by way of a connecting line.

Such a turbocharging process is disclosed in the German Offenlegungsschrift 26 48 411. The charging of the exhaust gas turbocharger which is inadequate during start and at partial load, is compensated thereby and a sufficiently high compression for the ignition of the fuel to be injected with corresponding temperatures during the starting, respectively, an improved combustion of the fuel with lower harmful emission of the exhaust gas during partial load operation is achieved in the engine cylinders notwithstanding the low compression ratio. Compared to other known processes, this process is simple, more reliable in operation, and realizable without large additional expenditures and extra space requirements.

However, it is disadvantageous with the process according to the German Offenlegungsschrift 26 48 411 that the supercharging of the engine cylinder attainable therewith is limited. A further lowering of the compression ratio in all cylinders, which is necessary for the improvement of the power-to-weight ratio of the internal combustion engine, is therewith not possible without negative reactions and repercussions on the start and partial load behavior.

Accordingly, it is the object of the present invention to increase the charge in the engine cylinder during start and partial load operation while far-reachingly maintaining the simple components of the known process.

The underlying problems are solved according to the present invention in that an air storage device is coordinated to the engine cylinder, which is connected with the engine cylinder by way of a line adapted to be closed off by a valve and which is charged by at least one further cylinder of the internal combustion engine, and in that the valve is controlled by the pressure of the compressed air of the compressor cylinder charging the engine cylinder in such a manner that the air of the air storage device together with the air of the compressor cylinder charges the engine cylinder.

The advantage of the present invention resides in that the engine cylinder can be charged more fully without the need for a separate control for the transfer of the charging air accumulated in the air storage device to the engine cylinder. The cylinders charging the air storage device can thereby be selected according to oscillating points of view or other technical points of view. The process is applicable advantageously above all to internal combustion engines having a small number of cylinders.

These and other objects, features and advantages of the present invention will become more apparent from the following description when taken in connection with the accompanying drawing which shows, for purposes of illustration only, one embodiment in accordance with the present invention, and wherein:

The single FIGURE is a schematic view of a supercharged diesel internal combustion engine in accordance with the present invention.

Referring now to the single FIGURE of the drawing, a diesel internal combustion engine 10 with six cylinders 11 to 16 which can be operated with low compression ratio and with correspondingly high charging and therefore have a favorable power-to-weight ratio. However, for starting and at low partial loads, when the associated exhaust gas turbochargers do not make available any charging air or make available only small quantities of charging air, the compression end temperature attainable in the cylinders does not suffice for the ignition of the injected fuel. For that reason, only the cylinders 11 and 16 are operated as engine cylinders which are charged by the cylinders 12 and 13, respectively, 14 and 15 as compressor cylinders. As a result thereof, in addition to the air sucked-in by each engine cylinder, each engine cylinder is so strongly charged by the two compressor cylinders that also at very low compression ratio in the cylinders, the compression end temperature necessary for the ignition of the injected fuel is attainable reliably in both engine cylinders. Good starting conditions and an improved combustion with smaller harmful emission at partial load result therefrom.

The conditions for the engine cylinder 11 will now be described in detail hereinafter. A corresponding arrangement applies to the engine cylinder 16.

The engine cylinder 11 is charged in a known manner by the compressor cylinder 12 by way of a connecting line 19. A first valve 20 controlled corresponding to the operating condition of the internal combustion engine and a second check valve 21 which opens in the presence of an excess pressure on the compressor cylinder side, are arranged in this connecting line 19. The piston of the compressor cylinder 12 leads the piston of the engine cylinder 11 to such an extent that the engine cylinder 11 is charged during its compression stroke with the compressed air of the compressor cylinder 12.

In order to further increase the charging, an air storage device 22 of any known construction is coordinated according to the present invention to the engine cylinder 11, which is connected with the engine cylinder 11 by way of a line 24 adapted to be closed off by means of a valve 23. In addition to the valve 23, the line 24 also includes a check valve 25. The air storage device 22 is connected with the further compressor cylinder 13 by way of a line 26, a valve 27 and a check valve 28.

The normally closed valves 20 and 27 are controlled to open by a control pressure in a line 29 whereas the normally closed valve 23 is controlled to open by the pressure of the compressed air of the compressor cylinder 12 in a control line 30.

OPERATION

During normal operation at medium partial loads up to full load operation of the internal combustion engine, the control lines 29 and 30 are without pressure and therewith the valves 20, 23 and 27 are closed by spring force. All cylinders 11 to 16 are supplied with fuel and operate conventionally as engine cylinders.

During the start and in the operation at low partial loads, the fuel supply to the cylinders 12 to 15 is interrupted and the control line 29 is acted upon with control air. As a result thereof, the valves 20 and 27 are opened.

At first, the air storage device 22 is charged by the piston of the compressor cylinder 13 during its compression stroke. The check valve 28 is thereby opened by the compressed air. This valve 28 again closes the storage device 22 when the compression pressure drops below the storage pressure.

The subsequently following compression stroke of the piston of the compressor cylinder 12 charges the engine cylinder 11 directly by way of the line 19 and the check valve 21 since the piston of the compressor cylinder 12 leads the compression stroke of the engine cylinder 11. The valve 23 is controlled to open by the charging pressure which builds up in the control line 30, and as a result thereof, also the stored air content is utilized for the charging of the engine cylinder 11 corresponding to the pressure conditions which establish themselves.

The check valves 21 and 25 close as soon as the pressure in the engine cylinder 11 during the compression stroke of the piston thereof exceeds the charging pressure of the compressor cylinder 12 and of the air storage device 22. By reason of the high charging, a high compression end temperature is attained in the engine cylinder 11 which leads to a reliable ignition of the injected fuel and enables a white smoke-free partial load operation with few harmful components in the exhaust gas.

If during the transition toward the middle partial loads, the exhaust gas turbochargers (not shown) are capable to take over the supercharging of all cylinders by reason of the higher exhaust gas energy yield, then the engine-compressor operation is again cancelled by the control lowering the control pressure in the control line 29 together with the resulting closure of the valves 20 and 27, and all cylinders are supplied with fuel. As a result thereof, the internal combustion engine again operates normally in this operating condition up to full load.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A diesel internal combustion engine having a relatively low compression ratio and supercharged by exhaust gas turbocharger means, comprising several cylinder means, at least one cylinder means being operated as engine cylinder means during starting and at partial loads while another cylinder means is operated as compressor means charging the engine cylinder, the piston of the compressor cylinder means leading the piston of the engine cylinder means so far that the engine cylinder means is charged by the compressor cylinder means directly by way of a first connecting line, an air storage means coordinated to and operatively connected with the engine cylinder means by way of a second line including a valve means for closing said line, said air storage means being operable to be charged during starting and at partial loads by a further cylinder means of the internal combustion engine operatively connected with the air storage means, and said valve means being controlled by the pressure of the compressed air of the compressor cylinder means directly charging the engine cylinder means in such a manner that the air of the air storage means charges the engine cylinder means jointly with the air of the compressor cylinder means.

2. A diesel internal combustion engine according to claim 1, further comprising a valve means in said first line connecting the compressor cylinder means directly charging the engine cylinder means, and a valve means in the connection between the further compressor cylinder means and the storage means, said two last-mentioned valve means being normally closed and being opened as a function of engine operation during starting and at partial loads thereof.

3. A diesel internal combustion engine according to claim 2, further comprising check valve means opening in the direction toward the storage means in the connection between the further compressor cylinder means and the storage means, and check valve means in the connection between the valve means from the first-mentioned compressor cylinder means to the engine cylinder means.

4. A diesel internal combustion engine according to claim 3, further comprising check valve means in the connection between the valve means connected to the storage means and the engine cylinder means, said last-mentioned check valve means opening under pressure in the direction toward the engine cylinder means.

* * * * *